United States Patent [19]

Hess

[11] 4,262,348

[45] Apr. 14, 1981

[54] LIQUID OPERATED CLOCK

[76] Inventor: Richard H. Hess, 774 Commercial Ave., South San Francisco, Calif. 94080

[21] Appl. No.: 57,726

[22] Filed: Jul. 16, 1979

[51] Int. Cl.[3] ..... G04B 1/26; G04B 19/00

[52] U.S. Cl. ..... 368/65; 368/223

[58] Field of Search ..... 58/1 R, 2, 144; 137/552.7, 624.14; 368/65, 223

[56] References Cited

U.S. PATENT DOCUMENTS

| | | | |
|---|---|---|---|
| 3,815,352 | 6/1974 | Kiesling | 58/23 R |
| 4,028,877 | 6/1977 | Vatterott | 58/2 |

*Primary Examiner*—Vit W. Miska

*Attorney, Agent, or Firm*—Willis E. Higgins; Edward B. Gregg

[57] ABSTRACT

This liquid clock has a lower liquid reservoir and an upper-liquid reservoir connected by an overflow to the lower reservoir. A plurality of timekeeping reservoirs are positioned to allow liquid in them to stand at the same level as in the upper reservoir. Each of the timekeeping reservoirs has a liquid exit orifice which connects to one of a plurality of timekeeping tubes, each having timekeeping related indicia on it. A means is provided for dropping a liquid displacement member in each of the timekeeping reservoirs at predetermined time intervals, thus displacing liquid into the timekeeping tubes. A means for withdrawing the liquid displacement members from the timekeeping reservoirs does so between the predetermined time intervals. A pump supplies liquid to the upper reservoir from the lower liquid reservoir to maintain the level of liquid in the upper reservoir at the level of the overflow. Means is further provided for periodically emptying the timekeeping tubes at time related intervals. Flow of liquid through the timekeeping tubes provides an indication of time by changes of the liquid levels in the timekeeping tubes.

10 Claims, 7 Drawing Figures

LIQUID OPERATED CLOCK

BACKGROUND OF THE INVENTION

1. Field of the Invention

This invention relates to a new type of clock. More particularly, it relates to a clock in which flow of a liquid serves to indicate the time. Most especially, it relates to such a clock in which the flow of liquid to indicate time provides a source of interest and amusement to an observer of the clock in operation.

2. Description of the Prior Art.

Water clocks have been known since Roman times. Such clocks typically consist of a tank or reservoir with an opening at its bottom and gradations along the tank or reservoir representing the hours. The opening at the bottom of the tank or reservoir is of a calibrated size such that water dripping out of it lowers the level of the water in the tank or reservoir to give an indication of time based on its level. Such clocks must usually be filled once a day, and they cannot provide a highly accurate indication of time due to the limited number of gradations on them, typically only by hours or quarter hours.

Various mechanical clock designs have been proposed in which operation of the clock provides a source of amusement to an observer. For example, U.S. Pat. No. 4,077,198 discloses a clock which operates by movement of ball bearings or other spheres in its apparatus.

Although the timepiece art is a well developed one, unique clock designs continue to have interest and amusement value.

SUMMARY OF THE INVENTION

Accordingly, it is an object of this invention to provide a liquid operated clock having amusement or fascination value for an observer of its operation.

It is another object of the invention to provide a simple and reliable mechanism for a liquid operated clock having a high degree of accuracy.

It is a still further object of the invention to provide a clock in which time is indicated by the heights of a liquid in a plurality of columns.

It is yet another object of the invention to provide a liquid operated clock having an easily readable accuracy to within one minute.

It is a still further object of the invention to provide an accurate liquid operated clock in which water can be used reliably as the liquid.

The attainment of these and related objects may be achieved through use of the novel liquid operated clock herein disclosed. The clock includes a lower liquid reservoir connected to an upper liquid reservoir by means of a pump to move liquid from the lower reservoir to the upper reservoir and by means of an overflow connecting the two reservoirs. A plurality of timekeeping reservoirs are each connected to the upper reservoir and are positioned to allow liquid in them to stand at the overflow level in the upper reservoir. Each of the timekeeping reservoirs has a liquid exit orifice connected to one of a plurality of timekeeping tubes. The timekeeping tubes have timekeeping related indicia on them. Means is provided for dropping a liquid displacement member into each of the timekeeping reservoirs at predetermined intervals. As a result, liquid is displaced from the timekeeping reservoirs through their liquid orifices into the timekeeping tubes. Resulting changes in liquid levels of the timekeeping tubes provide an indication of time. Means is provided for withdrawing the liquid displacement members from the timekeeping reservoirs between the predetermined intervals. A means for emptying the timekeeping tubes does so at periodic intervals during operation of the clock.

In operation of the clock, the pump supplies liquid from the lower liquid reservoir to the upper liquid reservoir at a rate sufficient to maintain the liquid level in the upper reservoir at the overflow level. Excess liquid flows through the overflow into the lower reservoir. The liquid also flows into the timekeeping reservoirs to maintain them at the overflow level of the upper reservoir. Liquid is desirably displaced from a first one of the timekeeping reservoirs to a first one of the timekeeping tubes having minute gradations. When the first timekeeping tube is full, it is emptied to trigger displacement of liquid from a second timekeeping reservoir into a second timekeeping tube having gradations representing multiples of the total number of minutes to fill the first timekeeping tube, e.g., tens of minutes. The second timekeeping tube desirably takes an hour to fill in this manner. Emptying the second timekeeping tube triggers displacement of liquid from a third timekeeping reservoir into a third timekeeping tube, desirably having hour gradations. At the end of twelve hours, the third timekeeping tube empties, and the cycle of operation begins again.

The attainment of the foregoing and related objects, advantages and features of the invention should be more readily apparent to those skilled in the art after review of the following more detailed description of the invention, taken together with the drawings, in which:

DETAILED DESCRIPTION OF THE INVENTION

Figure 1:
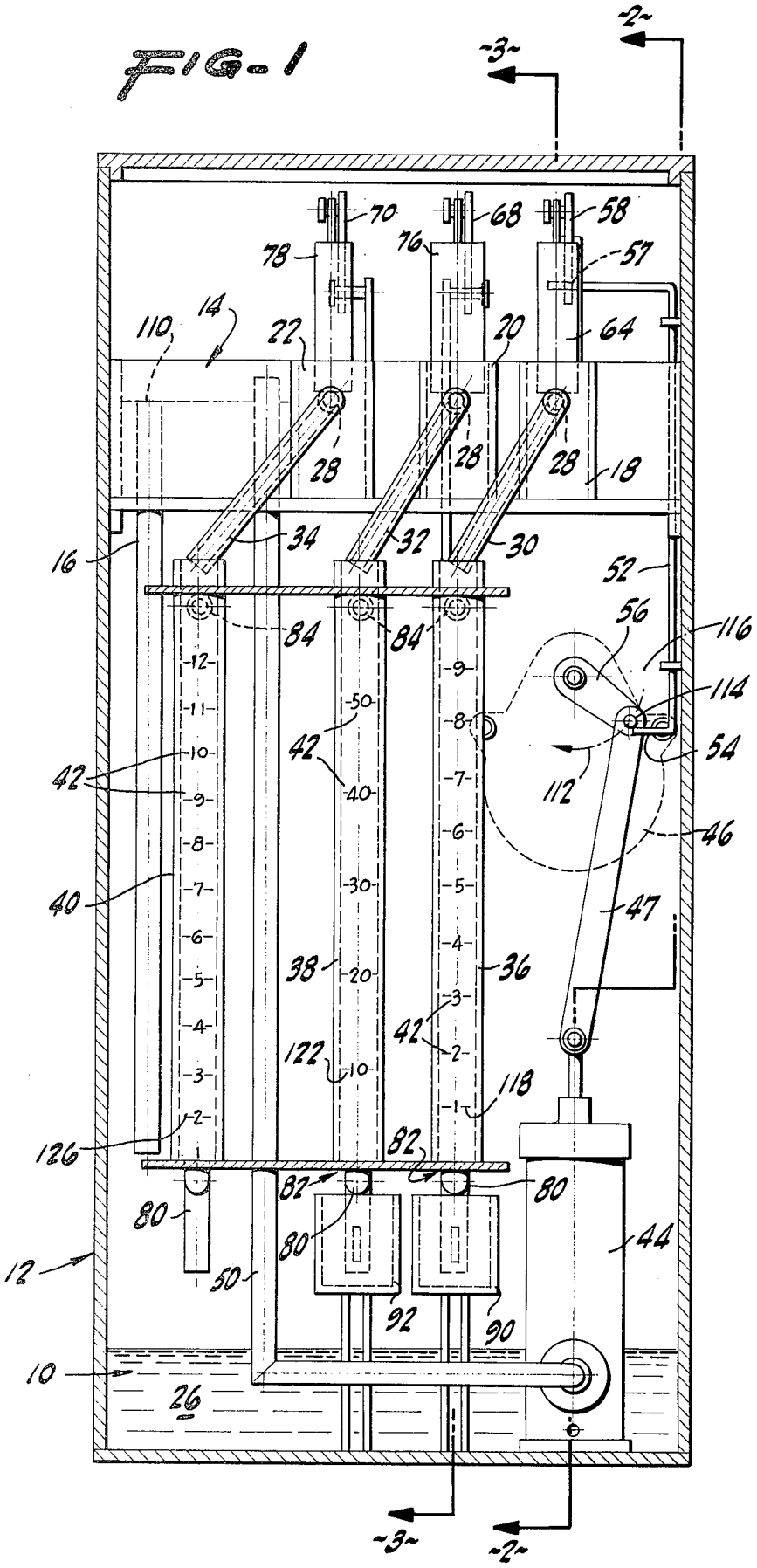
FIG. 1 is a front view of a liquid operated clock in accordance with the invention, but with its front panel removed, as shown by the line 1—1 in FIG. 2.
Figure 2:
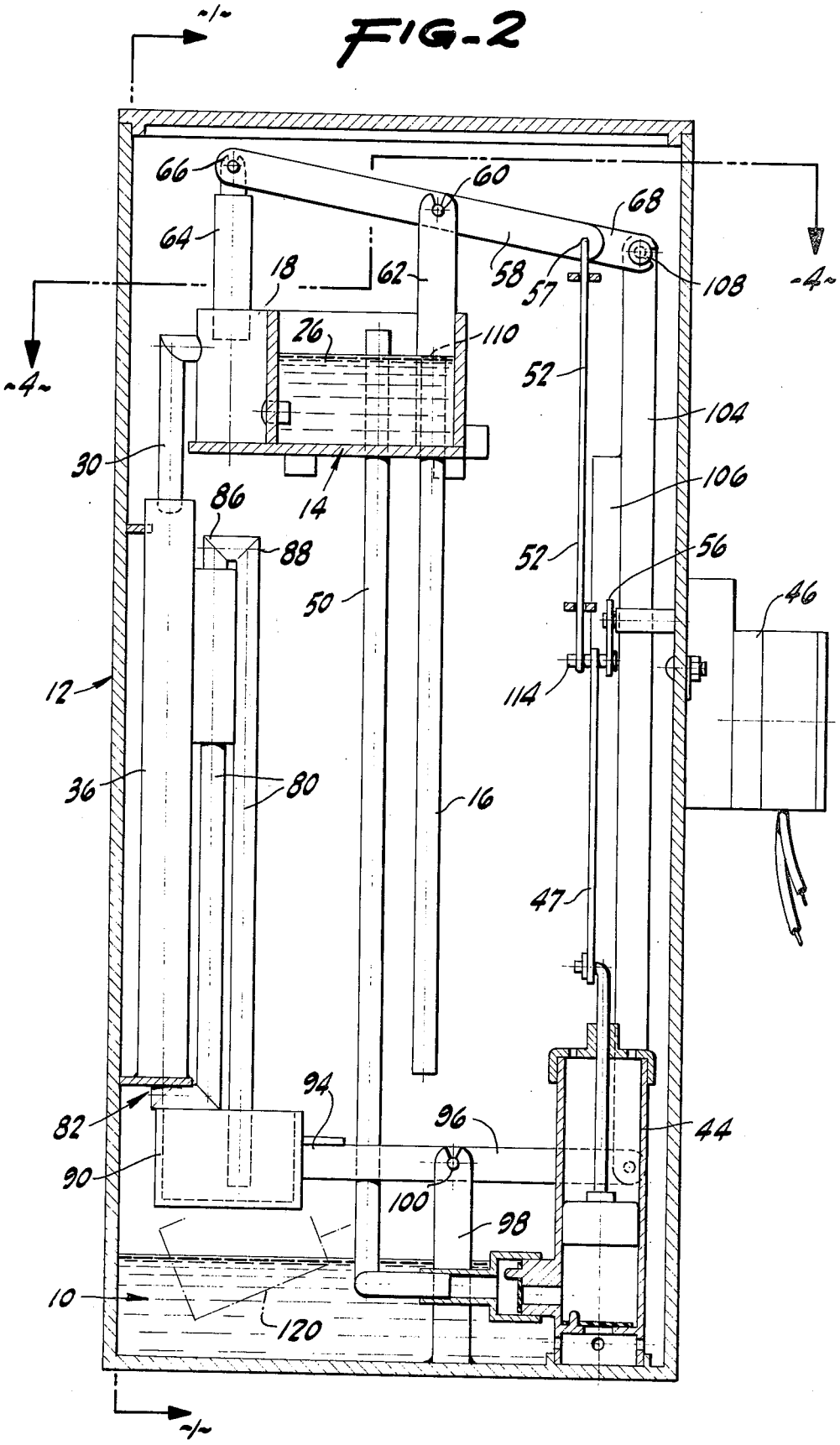
FIG. 2 is a side sectional view taken along the line 2—2 in FIG. 1.
Figure 3:
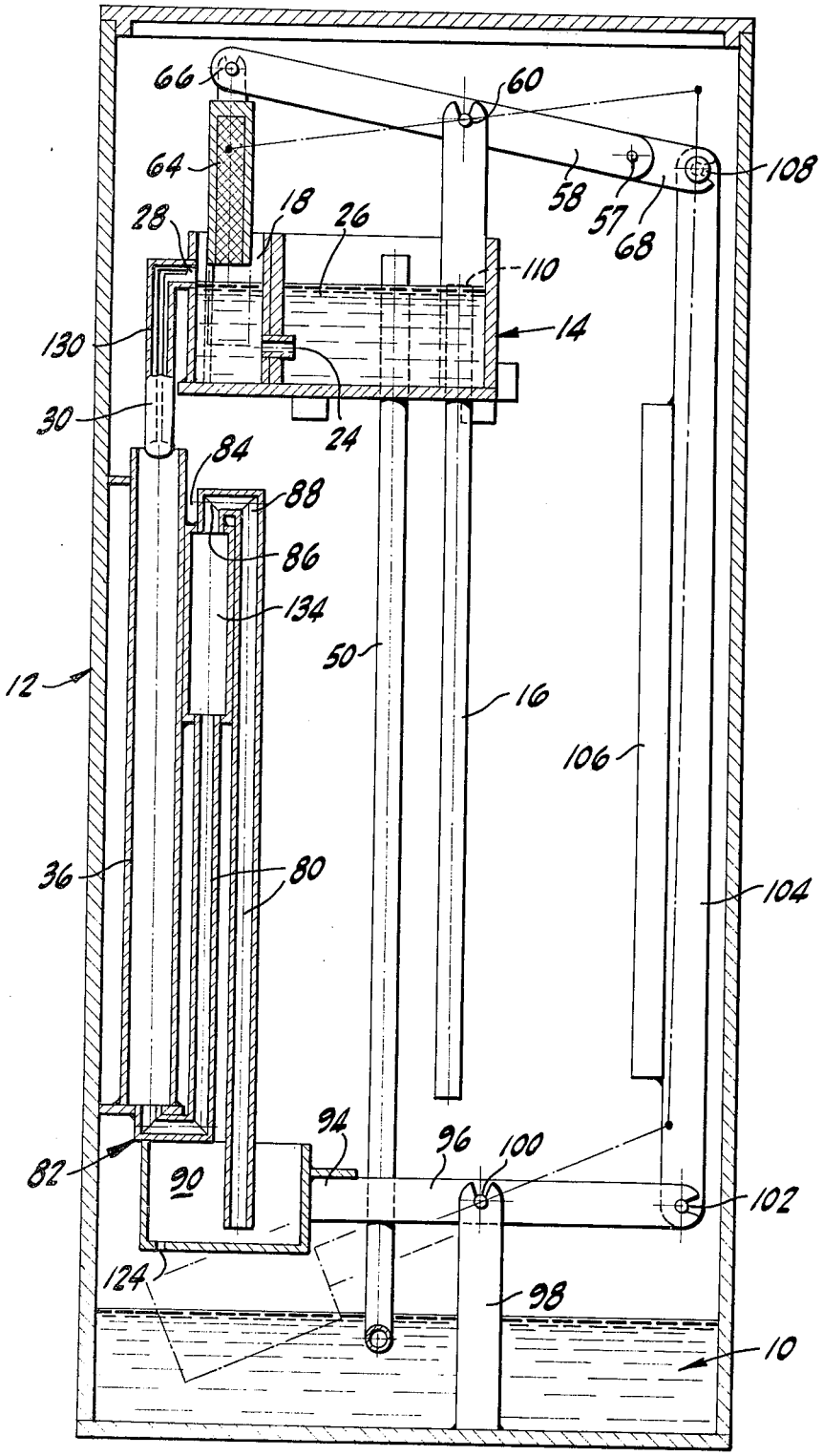
FIG. 3 is another side view of the clock shown in FIG. 1, but taken along the line 3—3.
Figure 4:
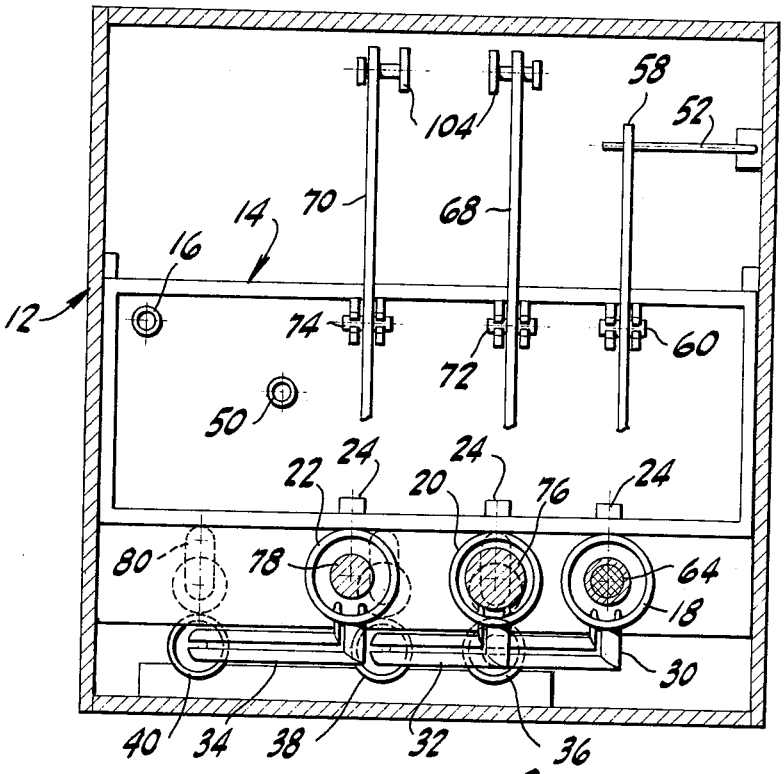
FIG. 4 is a top sectional view, taken along the line 4—4 in FIG. 2.

Turning now to the drawings, more particularly to FIGS. 1–4, a liquid clock in accordance with the invention is shown. The clock has a lower liquid reservoir 10, which is formed from the bottom portion of case 12. An upper reservoir 14 is provided near the top of case 12. It is connected to the lower reservoir 10 by means of an overflow tube 16. Three timekeeping reservoirs 18, 20 and 22 are located in front of the upper reservoir 14, as best shown in FIGS. 1 and 4. Each of the timekeeping reservoirs is connected to the upper reservoir 14 by means of an orifice 24, shown best in FIGS. 3 and 4. The orifice 24 allows water 26 (FIG. 2) to stand at the same level in the upper reservoir 14 and the timekeeping reservoirs 18–22. Each of the timekeeping reservoirs 18–22 has an exit orifice 28, seen best in FIGS. 1 and 3. The exit orifices 28 are connected to discharge tubes 30, 32 and 34, which lead to timekeeping tubes 36, 38 and 40. Each of the timekeeping tubes 36–40 has indicia 42 representing, respectively on each tube, minutes, tens of minutes and hours.

A piston pump 44 driven by electric motor drive 46 and linkage 47 supplies water 26 from the lower reservoir 10 to the upper reservoir 14 by means of tube 50. Mechanical linkage 47 is positioned to engage rod 52 at its end 54 once for each revolution of crank 56 of the linkage 47. Rod 52 is pivotally connected at end 57 of beam 58, pivotally mounted at 60 on support 62. A weight 64 is pivotally mounted at end 66 of beam 58 to suspend it over the first timekeeping reservoir 18, best shown in FIG. 2. Similar beams 68 and 70 are pivotally mounted at 72 and 74, respectively (see FIG. 4), to position weights 76 and 78 over the other two timekeeping reservoirs 20 and 22, respectively. However, only the first beam 58 is connected to rod 52.

The minutes and tens of minutes time keeping tubes 36 and 38 are each connected to a siphon tube 80 at their bottoms 82. The siphon tubes 80 form a serpentine path upward along the timekeeping tubes 36 and 38 to a predetermined level 84, where they have two right angle bends 86 and 88 to allow the tubes 80 to extend downward into first and second cups 90 and 92. The cups 90 and 92 are rigidly mounted at end 94 of a lever 96, which is pivotally mounted to support 98 at 100. Lever 96 is pivotally connected at 102 to vertical lever 104, which has a weight 106 mounted to it. One of the vertical levers 104 is pivotally connected at its end 108 to each of beams 68 and 70.

Figure 5:
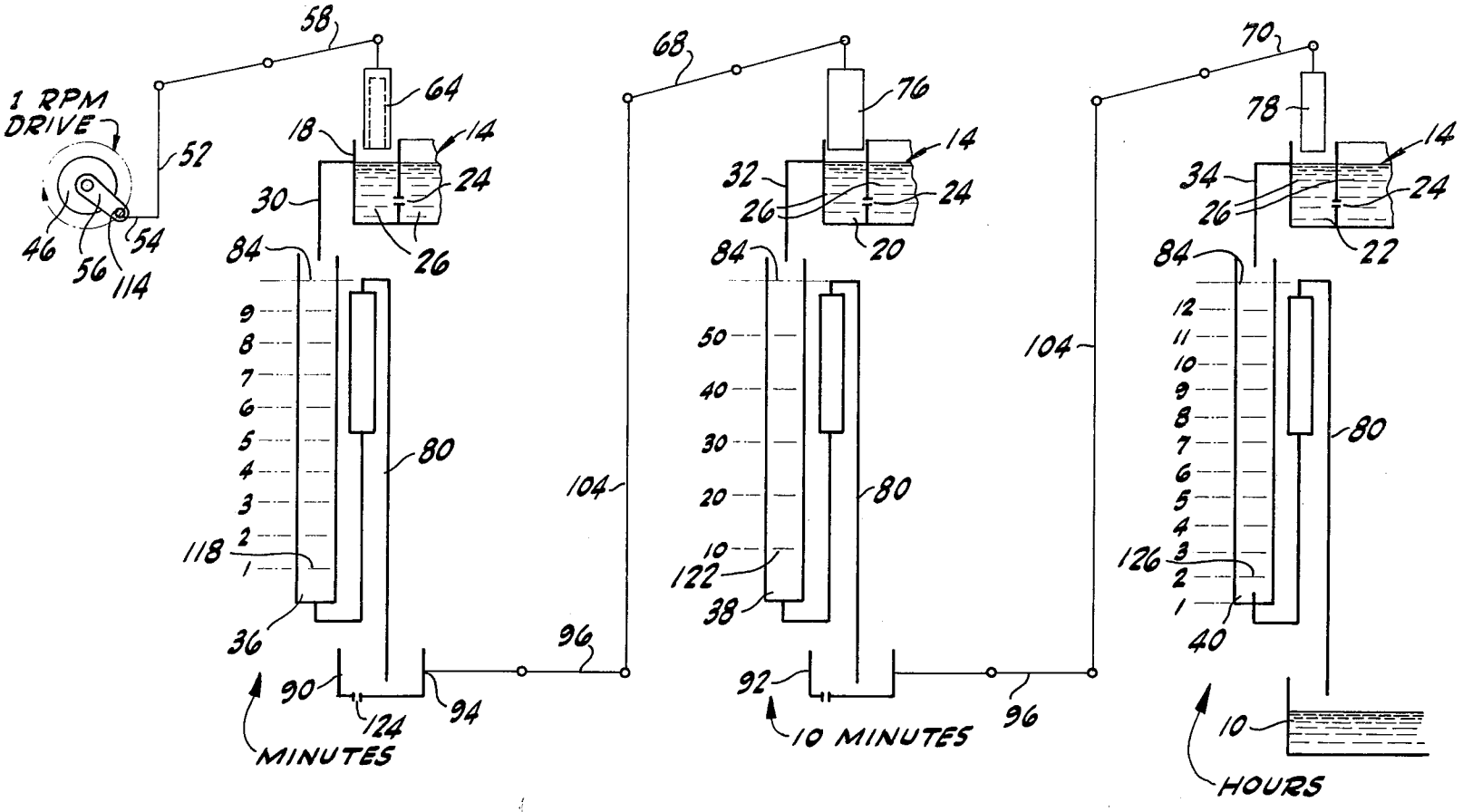
FIG. 5 is a schematic view useful for understanding operation of the clock shown in FIGS. 1–4.

The operation of the fluid clock will now be explained with the further assistance of FIG. 5, which shows certain of the elements in FIGS. 1–4 in schematic form and with corresponding reference numerals. A one revolution per minute (RPM) electric motor drive 46 drives piston pump 44 by means of linkage 47 to pump water 26 from bottom reservoir 10 to upper reservoir 14 through tube 50. In practice, the electric motor of drive 46 will have a higher RPM and drive a reduction gear train to produce an output of 1 RPM. The pump 44 provides an excess of water to the reservoir 14. The extra liquid 26 in reservoir 14 not employed in the operation of the clock returns to bottom reservoir 10 by means of overflow tube 16. As a result, a constant level of liquid 26 is maintained in the upper reservoir 14, determined by top 110 of the overflow tube 16. Connecting orifices 24 allow the level of water 26 to assume the same level in each of the timekeeping reservoirs 18, 20 and 22 as in upper reservoir 14.

At the start of operation, weight 64 is immersed in the minutes reservoir 18. As crank 56 rotates in a clockwise direction as shown by arrow 112 in FIG. 1, its end 114 engages end 54 of rod 52, then at position 116 in FIG. 1. The continued rotation of crank 56 lowers rod 52, thus pulling down on end 57 of beam 58 to raise weight 64 above the fluid level of first timekeeping reservoir 18, best seen in FIGS. 2 and 3. As the crank 56 continues to rotate, its end 114 disengages from end 54 of rod 52, allowing the rod 52 to move upward as weight 64 drops into first timekeeping reservoir 18 rapidly. Weight 64 displaces a volume of liquid 26 equal to its volume, thus directing a predetermined amount of the liquid 26 to minutes timekeeping tube 36 via connecting tube 30 to bring the liquid level in minutes tube 36 up to the one minute gradation mark 118. It should be noted that exit openings 28 from each of the timekeeping reservoirs 18–22 are substantially larger than the connecting orifices 24 between the upper reservoir 14 and each of the timekeeping reservoirs 18–22. Thus, most of the liquid displaced by the weights 64, 76 and 78 in operation of the clock is directed to the connecting tubes 30, 32, and 34, while a lesser amount moves back into the reservoir 14 through orifices 24. This arrangement eliminates the necessity for a check valve between timekeeping reservoirs 18–22 and the upper reservoir 14.

The above operation is repeated ten times during the first ten minutes of operation of the clock, to bring the liquid level in the minutes timekeeping tube 36 up to level 84 the tenth time that weight 64 is dropped into first timekeeping reservoir 18. When the liquid in tube 36 reaches level 84, its siphon tube 80 automatically siphons the liquid out of minutes timekeeping tube 36 into cup 90 to empty the minutes timekeeping tube 36. As cup 90 fills, its weight becomes great enough to pivot end 94 of rod 96 and cup 90 downward to the position shown at 120, thus moving weighted lever 104 upward and dropping the second weight 76 into the second timekeeping reservoir 20. This displaces liquid in the second timekeeping reservoir 20 in the same manner as in first timekeeping reservoir 18 to direct a predetermined quantity of the liquid through connecting tube 32 to second timekeeping reservoir 38, raising the liquid level in the second tube 38 to the first ten minute gradation 122. Orifice 124 in cup 90 allows the liquid in cup 90 to drain back into lower reservoir 10, slowly raising the weight 76 out of second timekeeping reservoir 20, thus readying it for a second cycle of operation when cup 90 again fills from first timekeeping tube 36.

Operation of the clock continues in this manner for the first hour of operation, until the liquid level in second timekeeping tube 38 reaches level 84. In the same manner as first timekeeping tube 36, second timekeeping tube 38 is then empted by its siphon 80 into second cup 92. At that time, second cup 92 drops to the position shown at 120 in FIG. 3, thus dropping third weight 78 into third timekeeping reservoir 22. When third weight 78 is dropped into third timekeeping reservoir 22 in this manner, it displaces liquid through exit tube 34 of the third timekeeping reservoir 22, into third timekeeping tube 40 to raise the liquid level in third timekeeping tube 40 to hour gradation 126, representing two o'clock. When the clock is operating, absence of liquid in third timekeeping tube 40 indicates one o'clock. Operation continues in this manner until the liquid level in third timekeeping tube 40 reaches the level 84 at the end of the twelfth hour of operation of the clock. At this time, the siphon tube 80 connected to third timekeeping tube 40 siphons the liquid out of third timekeeping tube 40 back into lower reservoir 10. The above cycle of operation is then repeated in successive twelve hour cycles to provide an indication of time by virtue of the liquid levels in the three timekeeping tubes 36, 38 and 40. At the conclusion of each 12 hour cycle, each of the timekeeping tubes 36, 38 and 40 are empty, so that the cycle can begin as first described above.

Figure 7:
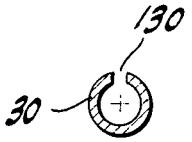
FIG. 7 is a cross section of a portion of the mechanism in FIG. 6, taken along the line 7—7.
Figure 6:
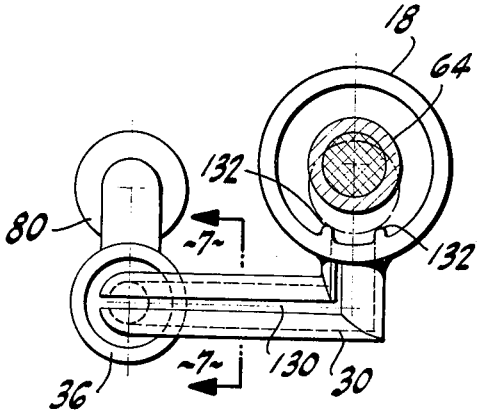
FIG. 6 is a portion of the mechanism shown in FIG. 4, enlarged to show detail.

FIGS. 6 and 7 show certain details of construction which are useful for insuring proper operation of the liquid clock when water is employed as the liquid. If water is used as the liquid, its surface tension against the walls of tubes 30, 32 and 34 can cause blockage of the flow from the timekeeping reservoirs 18–20 to the timekeeping tubes 36–40. For this reason, a slit 130 is provided in the top of the connecting tubes 30–34 to allow the escape of air trapped between water particles caught in the tube. If alcohol or an oil is employed as the liquid, no such problem is observed, due to the lower surface tension of those liquids. For a similar reason, ridges 132 are provided on the inside of the timekeeping reservoirs 18–22 to keep the weights 64, 76 and 78 spaced away from the interior walls of the timekeeping reservoirs 18–22, thus preventing surface tension from causing premature siphoning from the timekeeping reservoirs.

With water as the fluid, entrapped air in the siphon tubes 80 can also cause erratic siphoning. The provision of a short section of larger diameter tubing 134 (see FIG. 3) will overcome this problem so that the siphon will commence operation consistently when the water in the timekeeping tubes is at the level 84. Again, if alcohol or oil is used as the liquid, this problem is not observed due to the lower surface tension of those liquids.

It should now be apparent to those skilled in the art that a liquid operated clock capable of achieving the stated object of the invention has been provided. By using a plurality of liquid columns with associated timekeeping indicia, a liquid operated clock with an accuracy within one minute in an easily readable form is provided. Movement of the liquid during operation of the clock through the columns and the other portions of the mechanism provides amusement and fascination value for the observer. The clock further includes special features of construction which allow water to be employed as the operating liquid.

While the invention has been shown and described in a preferred embodiment, it should further be apparent to those skilled in the art that various changes in form and details of the invention may be made. It is intended that such changes be included within the spirit and scope of the claims appended hereto.

What is claimed is:

1. A liquid clock, which comprises:

(a) a lower liquid reservoir, (b) an upper liquid reservoir connected by an overflow to said lower reservoir, (c) a plurality of timekeeping reservoirs each connected to said upper reservoir and positioned to allow liquid in them to stand at the same level as in said upper reservoir, each of said timekeeping reservoirs having a liquid exit orifice, (d) a plurality of timekeeping tubes having timekeeping related indicia, each tube connected to receive liquid from the exit orifice of one of said plurality of timekeeping reservoirs, (e) means for dropping a liquid displacement member into each of said timekeeping reservoirs at predetermined time intervals, (f) means for withdrawing the liquid displacement member from said timekeeping reservoirs between said predetermined time intervals, and (g) a pump for supplying liquid to said upper reservoir from said lower liquid reservoir to maintain the level of liquid in the upper reservoir at the level of the overflow.

2. The liquid clock of claim 1 in which said upper reservoir is connected to each of said timekeeping reservoirs by a connecting orifice substantially smaller than said exit orifice.

3. The liquid clock of claim 1 in which said pump and at least one of said liquid displacement member withdrawing means are driven by a single motor.

4. The liquid clock of claim 1 in which said timekeeping reservoirs are each connected to one of said timekeeping tubes by connecting tubes having an opening along their upward disposed surfaces for escape of air entrapped in the liquid.

5. The liquid clock of claim 4 in which said timekeeping reservoirs each have an inner surface with at least one projection to space the liquid displacement means away from the remainder of the inner surface.

6. The liquid clock of claim 1 additionally comprising a siphon connected to the bottom of each tube, extending upward to a point near the top of each tube, reversing its direction and extending downward, so that the siphons will drain each timekeeping tube when it fills.

7. The liquid clock of claim 1 in which the siphons connected to a first and second one of said plurality of timekeeping tubes respectively drain into first and second cups connected by first and second linkages for respectively dropping a second and third one of said liquid displacement members into a second and third one of said timekeeping reservoirs.

8. The liquid clock of claim 7 in which said first and second cups have drain orifices for emptying said first and second cups into said lower liquid reservoir, the draining of said first and second cups respectively serving to withdraw the second and third ones of said liquid displacement members from the second and third ones of said timekeeping reservoirs.

9. A liquid clock, which comprises:

a plurality of timekeeping tubes, each having associated time related indicia, the time related indicia of successsive ones of said timekeeping tubes representing successively greater increments of time, the level of liquid in said timekeeping tubes being visible for, together with the time related indicia, providing an indication of time, means for introducing a quantity of liquid sufficient to fill a first one of said timekeeping tubes at an overall rate corresponding to the increments of time represented by its indicia to said first timekeeping tube by successively introducing a plurality of premeasured amounts of the liquid to said first timekeeping tube, and means responsive to the emptying of said first timekeeping tube for introducing liquid to a second one of said plurality of timekeeping tubes to fill said second timekeeping tube at an overall rate corresponding to the increments of time represented by its indicia, by successively introducing a plurality of premeasured amounts of the liquid to said second timekeeping tube.

10. The liquid clock of claim 9 in which each of said liquid introducing means comprises a liquid reservoir connected to one of said timekeeping tubes, means for filling the liquid reservoir to a predetermined level, and means for periodically displacing liquid from the reservoir to its associated timekeeping tube by sucessively introducing a displacing member into the liquid reservoir to raise its liquid level for displacing liquid from the reservoir to its associated timekeeping tube, then removing the displacing member from the liquid reservoir to allow the liquid displaced to be replaced by filling the liquid reservoir to the predetermined level while the displacing member is removed from the liquid reservoir.

* * * * *